US010227174B2

(12) United States Patent
Ng et al.

(10) Patent No.: US 10,227,174 B2
(45) Date of Patent: Mar. 12, 2019

(54) PACKAGE FOR SMOKING AND/OR TOBACCO RELATED ARTICLES, BLANK AND METHOD

(71) Applicant: REEMTSMA CIGARETTENFABRIKEN GmbH, Hamburg (DE)

(72) Inventors: Nigel Ng, Hamburg (DE); Christian Muenstermann, Hamburg (DE); Ulrike Kowalke, Hamburg (DE)

(73) Assignee: Reemtsma Cigarettenfabriken GmbH, Hamburg (DE)

( * ) Notice: Subject to any disclaimer, the term of this patent is extended or adjusted under 35 U.S.C. 154(b) by 156 days.

(21) Appl. No.: 15/309,633

(22) PCT Filed: May 8, 2015

(86) PCT No.: PCT/EP2015/060144
§ 371 (c)(1),
(2) Date: Nov. 8, 2016

(87) PCT Pub. No.: WO2015/169936
PCT Pub. Date: Nov. 12, 2015

(65) Prior Publication Data

US 2017/0217666 A1 Aug. 3, 2017

(30) Foreign Application Priority Data

May 9, 2014 (EP) ..... 14167669

(51) Int. Cl.
*B65D 85/10* (2006.01)
*B65D 5/52* (2006.01)

(52) U.S. Cl.
CPC ..... *B65D 85/1036* (2013.01); *B65D 5/5206* (2013.01); *B65D 5/526* (2013.01); *B65D 85/1045* (2013.01)

(58) Field of Classification Search
CPC ..... B65D 85/1036; B65D 5/5206
(Continued)

(56) References Cited

U.S. PATENT DOCUMENTS 1,775,618 A 9/1930 Kubler
2,402,062 A * 6/1946 Magill ..... B65D 5/5206 206/45.24

(Continued)

FOREIGN PATENT DOCUMENTS

CN 2880693 Y 3/2007
EP 2769926 * 8/2014

(Continued)

OTHER PUBLICATIONS

International Search Report dated Jul. 28, 2015 in PCT/EP2015/060144.
European Search Report dated Dec. 23, 2014 in EP 14167669.2.

*Primary Examiner* — Steven A. Reynolds
*Assistant Examiner* — Javier A Pagan
(74) *Attorney, Agent, or Firm* — Fox Rothschild LLP

(57) ABSTRACT

The invention relates to a package or package carton 1 for smoking articles and/or tobacco related articles, the package comprising a body 2 having at least a bottom wall 3, a top wall 4, a rear wall 5, a front wall 8 and two side walls 6, 7, the package further comprising an extension flap 9 coupled to the package and configured to be swiveled around a first hinge 10 between a first position and a second position with respect to the body of the package wherein the extension flap is further configured to support the package in the second position of the extension flap such that the body of the package stand securely and in an inclined position with respect to a (horizontal) plane on which the package rests.

20 Claims, 9 Drawing Sheets

(58) Field of Classification Search
USPC ..... 206/757
See application file for complete search history.

(56) References Cited

U.S. PATENT DOCUMENTS

| | | | | |
|---|---|---|---|---|
| 2,695,097 | A | 11/1954 | Easton | |
| 3,353,658 | A | 11/1967 | Ettin et al. | |
| 4,259,568 | A | 3/1981 | Dynesen | |
| 5,427,235 | A * | 6/1995 | Powell | B32B 27/08 206/245 |
| 2009/0317983 | A1 | 12/2009 | Miyanagi | |

FOREIGN PATENT DOCUMENTS

| | | | |
|---|---|---|---|
| FR | 1335237 | A | 8/1963 |
| FR | 2769292 | A1 | 4/1999 |
| JP | S491198 | A | 1/1974 |
| JP | S4926841 | A | 3/1974 |
| JP | 3145940 | A | 10/2008 |
| JP | S54-77777 | A | 4/2014 |
| WO | 2010069672 | A1 | 6/2010 |
| WO | 2011006943 | A1 | 1/2011 |
| WO | 2013108670 | A1 | 7/2013 |

* cited by examiner

PACKAGE FOR SMOKING AND/OR TOBACCO RELATED ARTICLES, BLANK AND METHOD

CROSS-REFERENCE TO RELATED APPLICATIONS

This application is a § 371 national stage entry of International Application No. PCT/EP2015/060144 filed May 8, 2015, which claims priority to and the benefit of European Application No. 14167669.2 filed May 9, 2014, both of which are hereby incorporated herein by reference in their entireties.

FIELD OF THE INVENTION

The invention relates to a package for smoking and/or tobacco related articles and a blank and a method for manufacturing the package.

BACKGROUND

Tobacco related articles, like cigarette or cigar packages, but also cigarettes or cigarillos, are often contained in disposable packages having a substantially cuboid or parallelepiped shape. A package or package carton is usually opened, a cigarette or a package of cigarettes is offered to another person by holding the open package in front of the guest. The guest may remove the article from the package and the host closes the package again. Dependent on the specific situation, it might, however, be desirable to keep the package open in an appealing manner as a sign of generosity or politeness, thereby maintaining the offer without necessitating the guest to ask for more. This usually requires to remove the articles from the package and to place them in an open box. The reason for this is that the conventional packages are either destroyed or not automatically held open. This particularly applies to boxes or also package cartons (also referred to as bundles) which are larger packaging units for cigarette packs. Typically, ten packs of cigarettes are combined to form one such package, which is wrapped by a paper or cardboard blank. The respective package cartons are either totally removed such that a certain number of separate packages remains loosely on the table or the remaining cigarette packages are kept within the package carton which requires opening the carton again.

SUMMARY

It is an object of the invention to provide a package carton and a package for smoking or tobacco related articles that allows keeping the package or package carton open in an appealing manner for offering smoking related articles or tobacco related articles from the package or package carton. It is also an object of the invention to provide a respective method for manufacturing the package or package carton and to provide one or more blanks for manufacturing the package.

According to an aspect of the invention, a package or package carton for smoking articles and/or tobacco related articles is provided. Within this specification the term package also comprises package cartons. The package comprises a body having at least a bottom wall, a top wall, a rear wall, and two side walls. The package further comprises an extension flap which is coupled to the package and configured to be swiveled about a first hinge between a first position and a second position with respect to the body of the package. In the first position, the flap lies against the body. In the second position, the first wall of the extension flap points away from the body. The extension flap is further configured to support the package in the second position of the extension flap such that the body of the package assumes an inclined position with respect to a (horizontal) plane and/or flat surface. This provides an appealing position of the package and the content of the package can easily be accessed.

Advantageously, the package, or more specifically, the body of the package takes a secure position on the extension flap and stands securely on the extension flap in the second position of the extension flap. In other words, the extension flap can remain in the second position and the package can be placed on a surface with its rear side facing the surface and resting on the extension flap, thereby providing an appealing offer of the articles contained in the package. The articles can be cigarette packages, cigar or small cigar packages or elongate articles as, for example, smoking articles or tobacco related articles, such as cigarettes, e-cigarettes, cigars or snus or the like. The second position is preferably stable to the extent that any resilient forces provided by the hinge are not high enough to move or lift the package and thereby change the position of the supporting extension flap. The package cannot return by itself to another position. To this extent, the second position can also be referred to as a stable open position.

The extension flap does not form an integral part of a wall of the body. The extension flap is coupled to the body, but it is not, for example a cutout of a wall of the body. The extension flap is an additional element. In particular, the extension flap is not a part of the rear wall of the body.

The extension flap can be coupled by the first hinge to an edge of the body of the package. The edge of the body to which the extension flap is coupled can be an upper edge of the rear wall of the body such that the first hinge is located between the rear wall and the top wall of the package and the extension flap. This provides that the flap can be swiveled behind the body of the package and support the package from the rear side (rear wall side) and front of the body points towards the consumer.

The extension flap can at least partially encompass the body in the first position. In other words, the flap is more or less wound around the body and envelops or wraps the body in the first position.

Advantageously, in addition to the coupling by the first hinge the extension flap can further be detachably coupled to the body in the first position. This additional coupling mechanism between the extension flap and the body holds the flap against the body in the first position. The coupling can be a glued, hook-and-loop, push-fit, magnetic, and/or a snap-fastener connection. The coupling mechanism can also be based on magnetism, magnetic ink, Velcro® (a hook-and-loop fastener), YUPOTako® (a film or paper having a microsuction side), buttons, tuck-in flaps. In another configuration, the extension flap may be coupled to the walls of the body by cutting lines (perforations) except of the first hinge by which the extension flap always remains coupled to the body. Another advantageous mechanism is magnetism. For this purpose magnetic parts may be integrated into the extension flap and the body in respective corresponding locations.

The extension flap can comprise at least a first wall and a second wall. The first wall and the second wall can be coupled by a second hinge. In the first position of the extension flap, the first wall can then cover a first side or a first wall of the body and the second wall can cover a second side or a second wall of the body. The first side of the body can be the top side of the body. Likewise, the first wall of the body can be the top wall. The second side can be the front side of the body. This means that the extension flap can at least partially serve as the top wall and/or front wall of the body. In another embodiment, the body may comprise a complete top wall and a complete front wall. The first wall is then the top wall and the second wall is then the front wall of the package, both being covered by the extension flap in the first position.

The package can further be configured such that the body rests on the second wall of the extension flap and on a lower edge (for example the edge between the rear wall and the bottom wall of the body) of the rear wall of the body in the second position. However, the lower edge of the rear wall may also rest on the second wall of the extension flap. This further supports a secure stand of the package in the second position.

The first wall of the extension flap can at least approximately have the size of the top wall of the body and the second wall can at least approximately have the size of the front wall of the body.

The front wall of the body can be coupled by a third hinge to one of the side walls of the body for swiveling the front wall about the third hinge in order to open and close the body of the package.

The package may have various shapes. The package can have a substantially parallelepiped shape. However, the edges of the package can be round or beveled. The cross sectional shape of the package may be semi-octagonal, or octagonal. In particular, the longitudinal and/or transverse edges of the body may advantageously be rounded edges or the edges may be flattened edges (flattened corners) or beveled edges.

The walls of the body and/or the walls of the extension flap can be configured such that the rotating angle around any one of the first, second and/or third hinges is limited. This supports a secure stand and prevents that, for example the extension flap is not swiveled too far towards the rear wall of the body and may then fail to properly support the package in the second position of the extension flap. The rotating angle of any of the hinges may be limited by the thickness of the walls such that the edges of respective two walls on either side of a hinge abut and thereby stop the rotation about the hinge. An advantageous range for anyone of the rotating angles around any one of the hinges, especially the first and second hinge, is between 160° and about 360°, preferably between 180° and 340°.

In an embodiment, at least the second hinge may have a rotating angle of less than 180°. In such an embodiment, the second wall may be rotatable in the opposite direction than in the other embodiments. The initial angle between the first wall and the second wall in the first position (closed position) is about 90°. This can typically also be the case in other embodiments. The first wall can be swiveled around the first hinge similar to the other embodiments. The second wall can, however, not be swiveled in the same direction about the second hinge as in the other embodiments. If, from a side perspective, the first wall is swiveled or rotatable in a clockwise direction, the second wall is rather swiveled or rotatable in a counter-clockwise direction about the second hinge. The package stands securely on the extension flap. However, the outer edge of the second wall now points away from the rear bottom edge of the bottom wall of the body. In this embodiment, the second hinge can advantageously have a limitation mechanism for the angle of rotation. This mechanism can be provided by the thickness of walls and/or the configuration of the second hinge.

Generally, the extension flap and in particular, the second wall can have a stopping member in order to prevent the body from slipping from the extension flap. The stopping member can be a groove or notch. The stopping member can also be one or more protrusions on the extension flap. The groove, notch, protrusion or protrusion can especially be arranged on the inner side of the second wall of the extension flap. The body, in particular the lower edge of the body can then rest in the groove or on the protrusion or protrusions.

In an aspect of the invention, the extension flap and in particular, the first wall and/or the second wall can comprise one or more folding lines or hinge lines for hingedly dividing the first wall and/or second wall into further partial walls.

Furthermore, the package may further comprise an additional outer package which encompassed the previously described package.

The invention also provides a blank for manufacturing the package according to the aspects and embodiments of the invention.

The invention further provides a method of manufacturing a package according to the aspects and embodiments of the invention.

BRIEF DESCRIPTION OF DRAWINGS

Further aspects and characteristics of the invention ensue from the following description of the preferred embodiments of the invention with reference to the accompanying drawings, wherein.

DETAILED DESCRIPTION OF AN EXAMPLE EMBODIMENT

Figure 1:
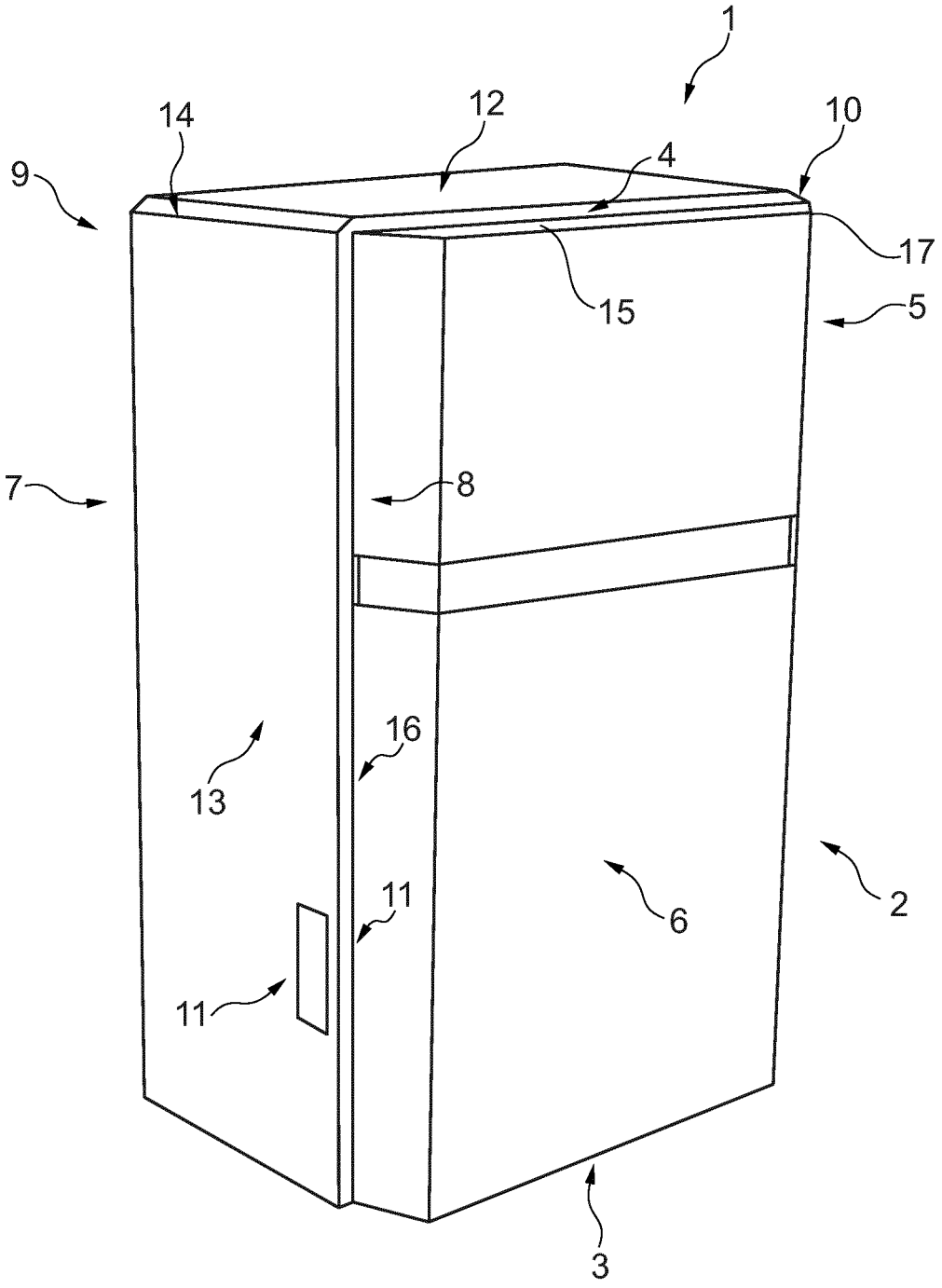
FIG. 1 is a simplified perspective view on the package in the first position of the extension flap according to an embodiment.

FIG. 1 is simplified perspective view on the package in the first position of the extension flap according to an embodiment. The package 1 comprises a body 2 having a bottom wall 3 (not visible), a top wall 4, a rear wall 5 (not visible), and two side walls 6, 7 (7 not visible). In this embodiment, the body 2 has a front wall 8. The package 1 further comprises an extension flap 9 which is coupled to the package 1. The extension flap 9 is in the first position and encompasses the top wall 4 and front wall 8. In other words, the extension flap 9 is at least partly wound around the body 2 and at least partly envelops or wraps the body 2 in the first position. The extension flap 9 is configured to be swiveled about a first hinge 10 between the first position and the second position (shown in subsequent drawings) with respect to the body 2 of the package 1.

In addition to the coupling by the first hinge, the extension flap 9 is further detachably coupled to the body 2 in the first position by an additional mechanism. This additional coupling mechanism (not visible) between the extension flap and the body holds the flap 9 against the body 2 in the first position. In this embodiment, the coupling is based on magnetism. For this purpose magnetic parts (dashed lines, not visible on the final package) are integrated into the extension flap 9 and the body 2 in respective corresponding locations 11. The first hinge In other embodiments, the additional coupling mechanism can be a glued, hook-and-loop, push-fit, magnetic, and/or a snap-fastener connection. The coupling mechanism can also be based on magnetism, magnetic ink, Velcro® (a hook-and-loop fastener), YUPOTako® (a film or paper having a microsuction side), buttons, tuck-in flaps. In another configuration, the extension flap 9 may be coupled to the walls of the body 2 by cutting lines (perforations) except of the first hinge, of course, by which the extension flap always remains coupled to the body.

The extension flap comprises a first wall 12 and a second wall 13. The first wall 12 and the second wall 13 are coupled by a second hinge 14. In the shown first position of the extension flap 9, the first wall 12 covers the top wall 4 of the body 2 and the second wall 13 covers the front wall 8 of the body 2.

The first wall 12 of the extension flap 9 has approximately the size of the top wall 4 of the body 2 except for the beveled edges 15. The second wall 13 has approximately the size of the front wall 8 of the body 2 except for the beveled edges 16.

The extension flap 9 is coupled by the first hinge 10 to an edge 17 of the body of the package. The extension flap 9 does not form part of a wall of the body 2, for example as a cutout of a wall. The extension flap 9 is an additional element. In particular, the extension flap 9 is not a part of the rear wall 5 of the body 2. The edge 17 of the body 2 to which the extension flap 9 is coupled is an upper edge of the rear wall 5 of the body 2 such that the first hinge is located between the rear wall 5 and the top wall 4 of the package and the extension flap 9. This provides that the flap 9 can be swiveled behind the body 2 of the package 1 and support the package 1 from the rear side (rear wall side).

The package may have various shapes. In this embodiment, the package 1 has a substantially parallelepiped shape. The longitudinal and transverse edges 15, 16 of the body 2 are beveled edges. The line around the body (no reference number) has no technical function and serves only for aesthetic purposes.

Figure 2:
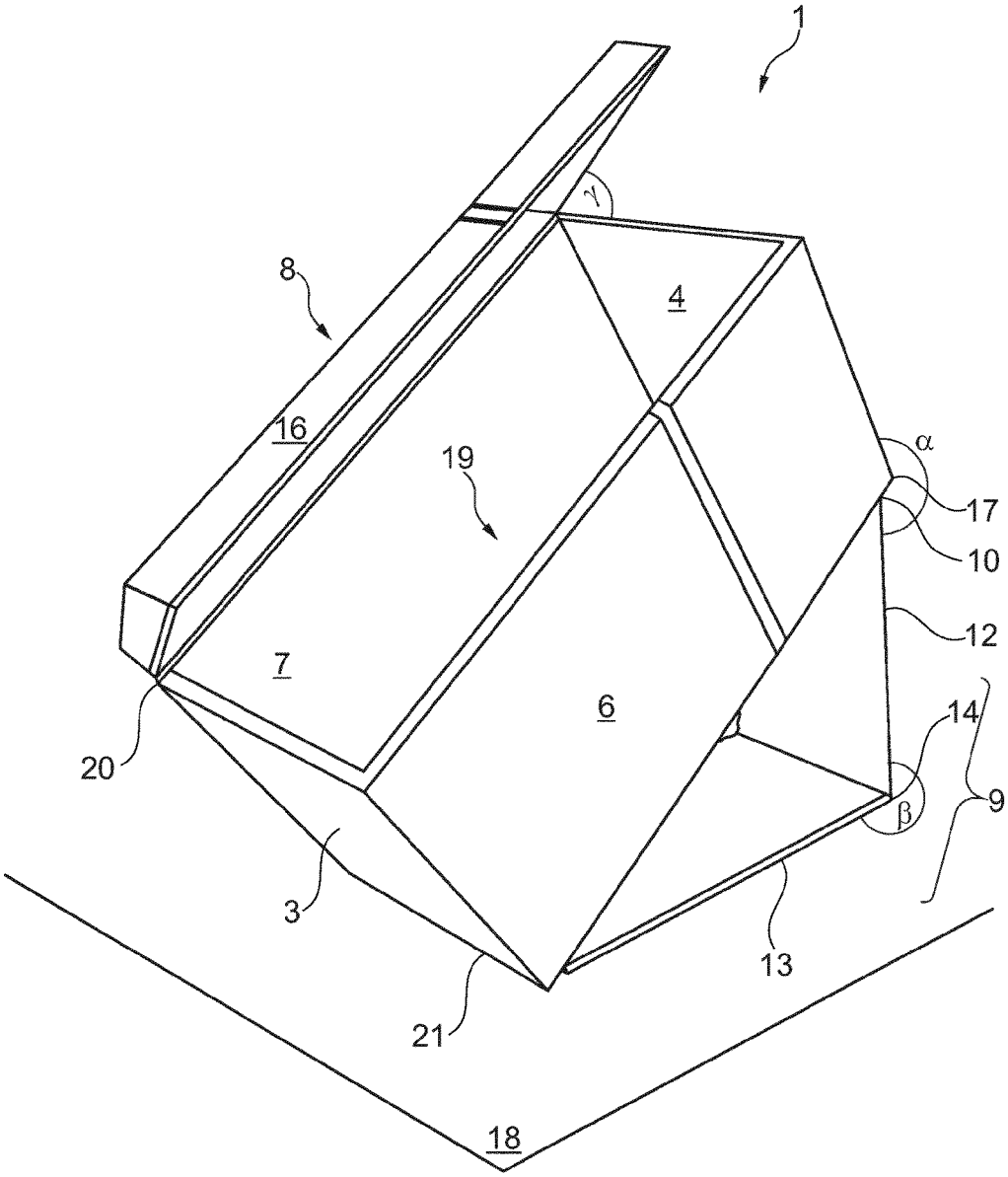
FIG. 2 is a simplified perspective view on the package in the second position of the extension flap according to an embodiment.
Figure 3:
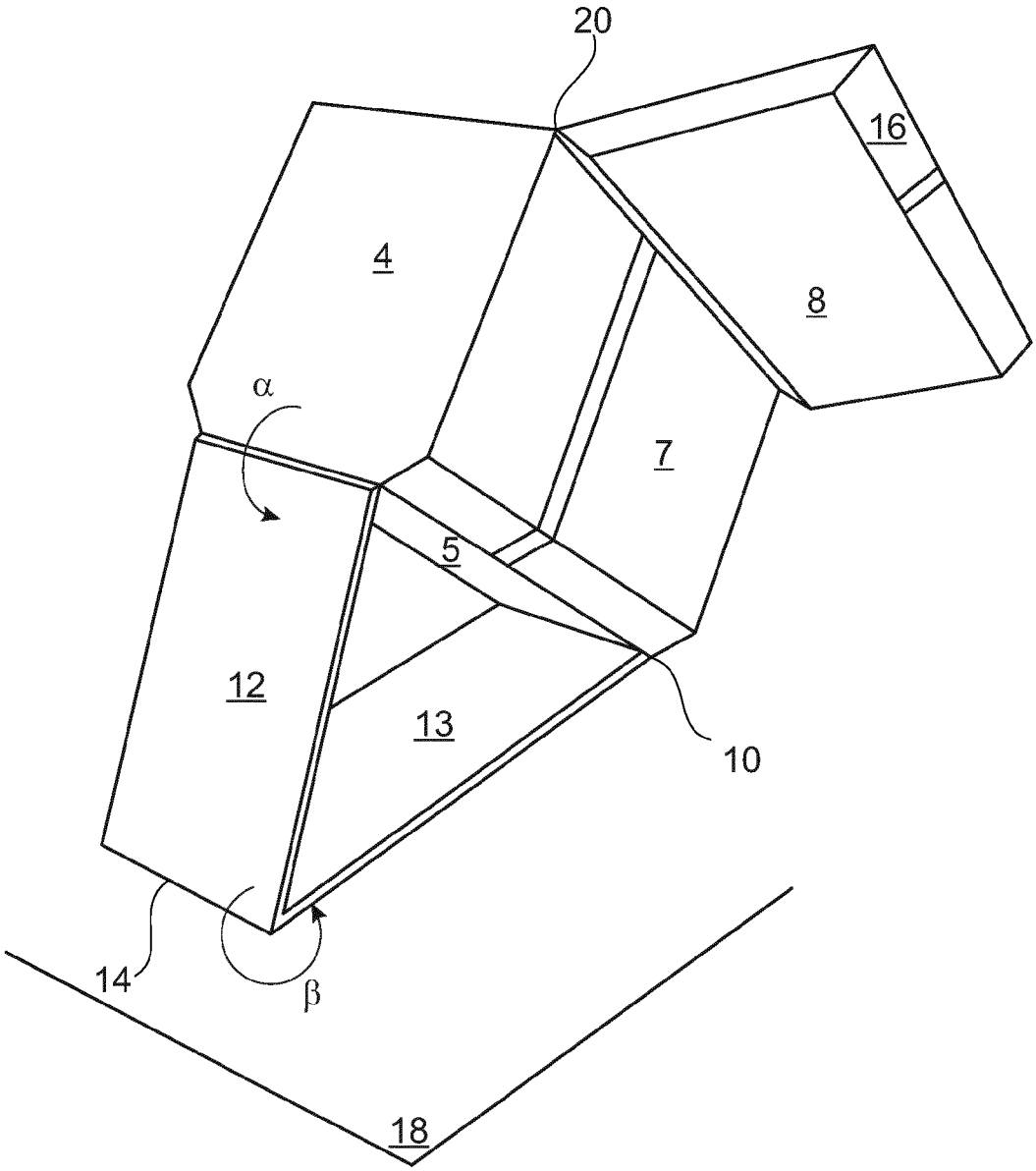
FIG. 3 is another simplified perspective view on the package in the second position of the extension flap according to an embodiment.

FIG. 2 and FIG. 3 are simplified perspective views on the package 1 in the second position of the extension flap of the same embodiment of the package 1, which is also shown in FIG. 1. In the second position, the extension flap 9 points away from the body 2. The extension flap 9 is further configured to support the package 1 (or rather the body 2) in the second position of the extension flap 9 such that the body 2 of the package takes a secure inclined position on the extension flap and stands securely and obliquely on the extension flap in the second position of the extension flap. The body 2 has an inclined or oblique position with respect to a (horizontal) plane 18. This provides an appealing position of the package 1 and the inner space 19 of the package 1 can easily be accessed. The body 2 rests on the second wall 13 of the extension flap 9. The body also rests on a lower edge 21 (edge between rear wall 5 and bottom wall 3) of the rear wall 5 of the body 2. However, the lower edge 21 of the rear wall 5 may also rest on the second wall 13 of the extension flap 9.

The body 2 of the package assumes as secure stand on the extension flap 9 in the second position of the extension flap 9. In the second position, the package can be placed on a surface 18 with its rear side facing the surface and resting on the extension flap 9. The articles (not shown) can be cigarette packages, cigar (small cigar) packages or elongate articles as, for example, smoking articles or tobacco related articles, such as cigarettes, e-cigarettes, cigars or snus or the like.

The second position is stable to the extent that any resilient force provided by the hinges 10, 14 are not high enough to move or lift the package 1 and thereby change the position of the supporting extension flap 9. The package 1 cannot return by itself to another position.

The front wall 8 of the body 2 is coupled by a third hinge 20 to one of the side walls (here side wall 7) of the body 2 for swiveling the front wall 8 about the third hinge 20 in order to open and close the inner space 19 of the body 2 of the package 1.

The walls of the body 2 and/or the walls of the extension flap 9 are configured such that the rotating angles $\alpha$, $\beta$ and/or $\gamma$ around any one of the first, second and/or third hinges 10, 14, 20 is limited. This supports a secure stand and prevents that, for example the extension flap 9 is swiveled too far towards the rear wall 5 of the body 2 and may then fail to properly support the package 1 in the second position of the extension flap 9. The rotating angle $\alpha$, $\beta$ and/or $\gamma$ of any of the hinges can be limited by the thickness of the first and second walls 12, 13, and body walls 5, 7, 8 and/or the specific configuration of the hinges 10, 14, 20 such that the edges of respective two walls on either side of a hinge abut and thereby stop the rotation about the hinge 10, 14, 20.

Figure 4:
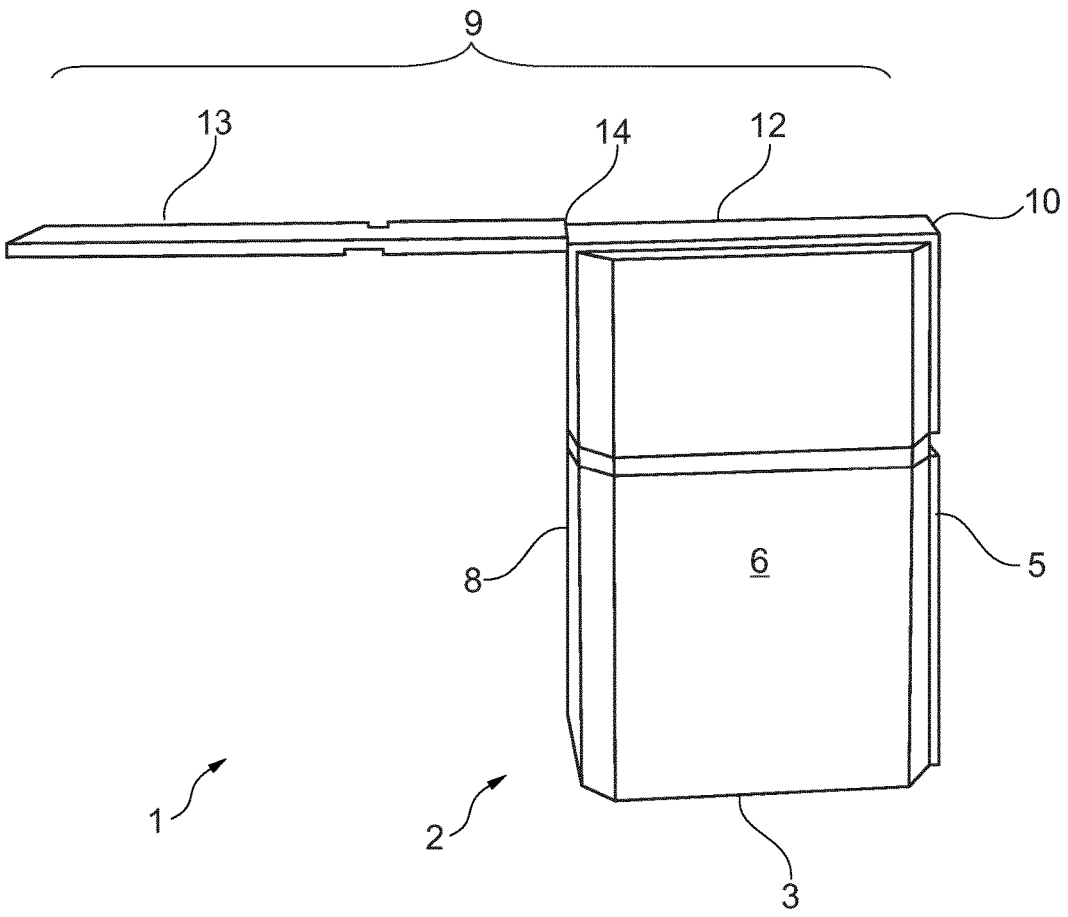
FIGS. 4 to 6 show a sequence of simplified side views on the package illustrating the movement of the extension flap from the first position to the second position according to an embodiment.
Figure 5:
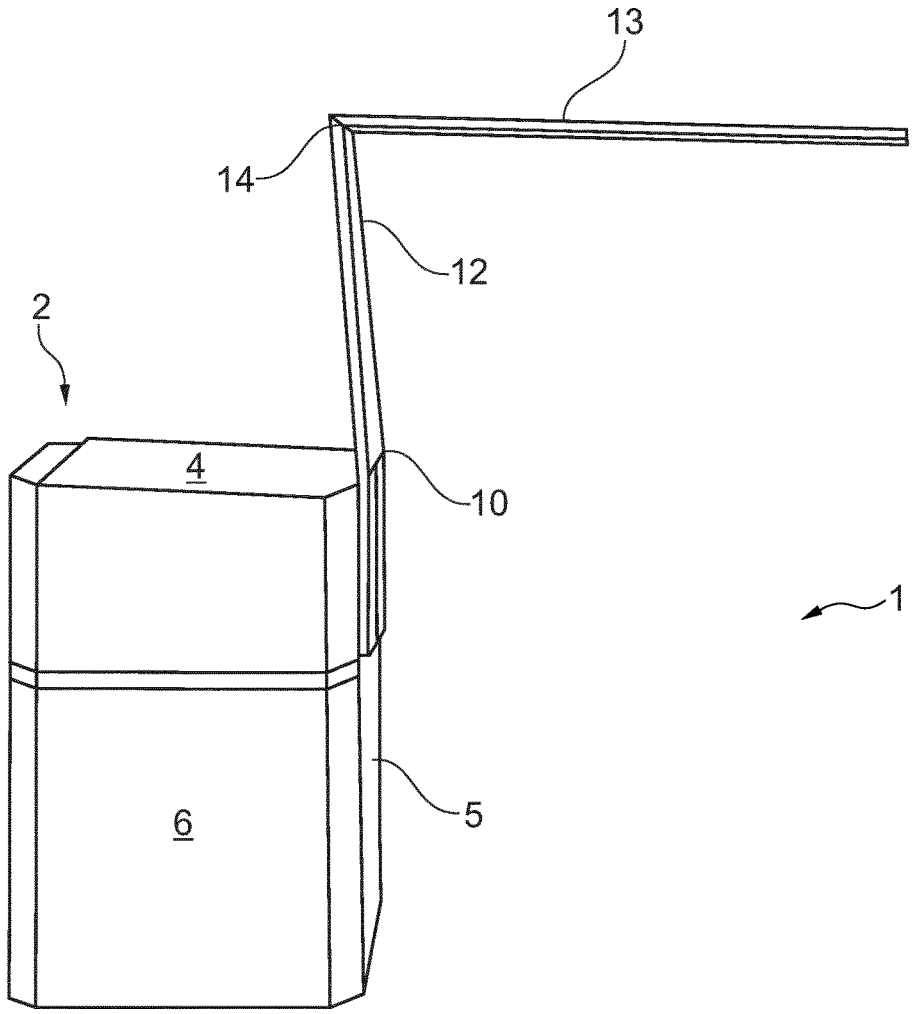
Figure 6:
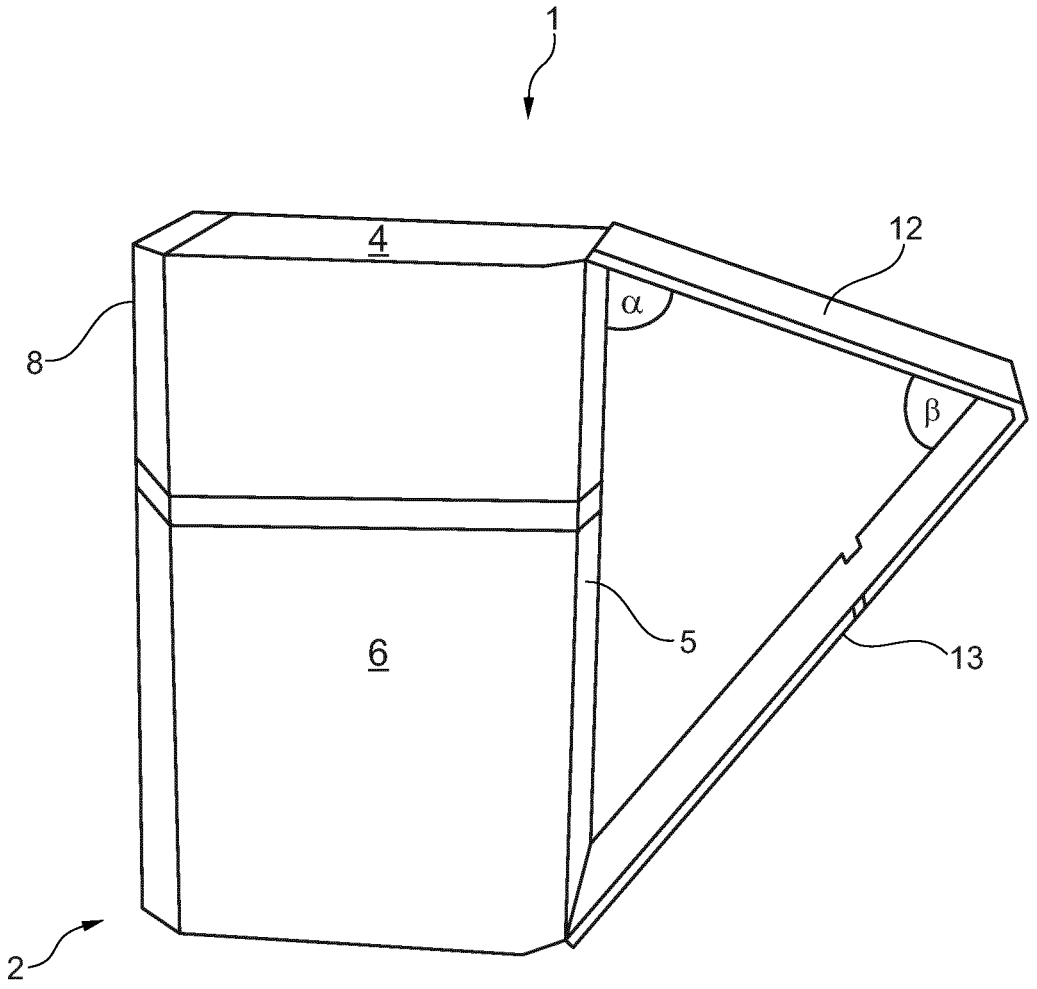

FIGS. 4 to 6 show a sequence of simplified side views on the package illustrating the movement of the extension flap from the first position to the second position according to an embodiment. In a first step (FIG. 4), the second wall 13 of the extension flap 9 is swiveled about the second hinge 14 and thereby away from the front wall 8 of the body 2 of the package 1. In a second step (FIG. 5), the second wall 13 of the extension flap 9 is swiveled further about the second hinge 14 and also moved towards the rear wall 5 side of the body 2, such that also the first wall 12 of the extension flap 9 starts swiveling around the first hinge 10. This movement continues (FIG. 6) until the rear wall 5 of the body 2 and the first wall 12 of the extension wall assume an angle $\alpha$ which is greater than 180° and smaller than 360° and the first and second walls 12, 13 of the extension flap 9 also assume an angle $\beta$ which is also greater than 180° and smaller than 360° (about 340° maximum). The package can now be placed on the second wall 13 of the extension flap as shown in FIG. 2 and FIG. 3. The front all 8 can then be opened and remain open.

Figure 7:
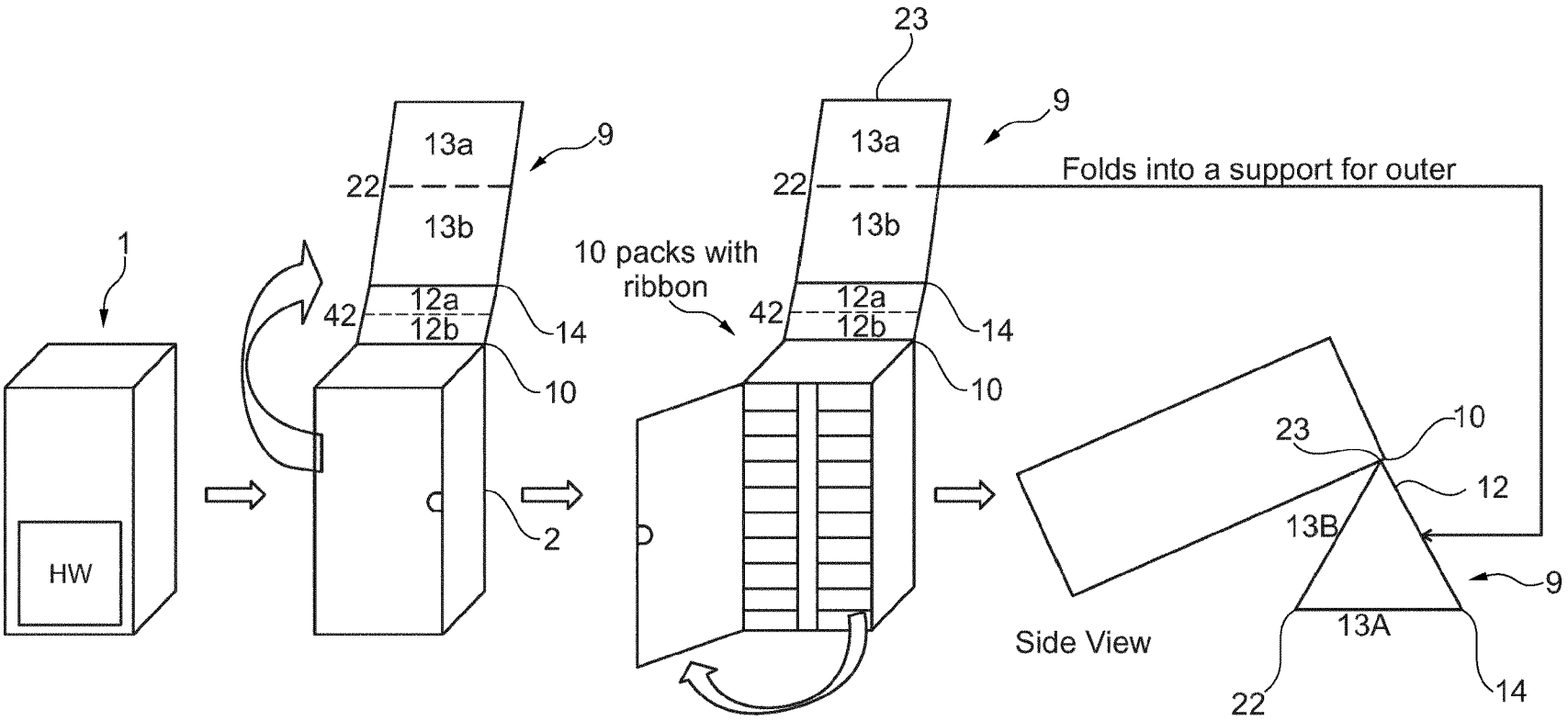
FIG. 7 is a simplified representation of an embodiment of the package.

FIG. 7 is a simplified representation of a slightly different embodiment of the package 1. The embodiment is substantially the same as the one shown in the previous drawings. However, the extension flap 9 now further comprises an additional folding line or hinge 22 or 42 within the first wall (12) and/or the second wall 13, thereby creating additional walls, i.e. walls 12B and/or 13B as a third and/or a fourth wall. This allows that the outer part 12A and/or 13A can be folded further backwards towards the rear wall 5 of the package. The two parts 12A and 12B of the first wall 12 and/or the two parts 13A and 13B of the second wall 13 on opposite sides of the respective optional folding or hinge lines 22 or 40 now assume an angle δ which is smaller than 180°. The outer edge 23 of the second wall 13 can now get in contact with the rear wall 5 of the body and even with the first hinge 10. This provides a very stable mainly triangular supporting foot for the package 1. The angle α can now even be smaller than 180°.

According to this embodiment, the extension flap 9 and in particular, the first wall 12 and/or the second wall 13 comprise one or more folding lines or hinge lines for hingedly dividing the first wall 12 and/or second wall 13 into further partial walls 12A, 12B, and 13A, 13B.

Figure 8:
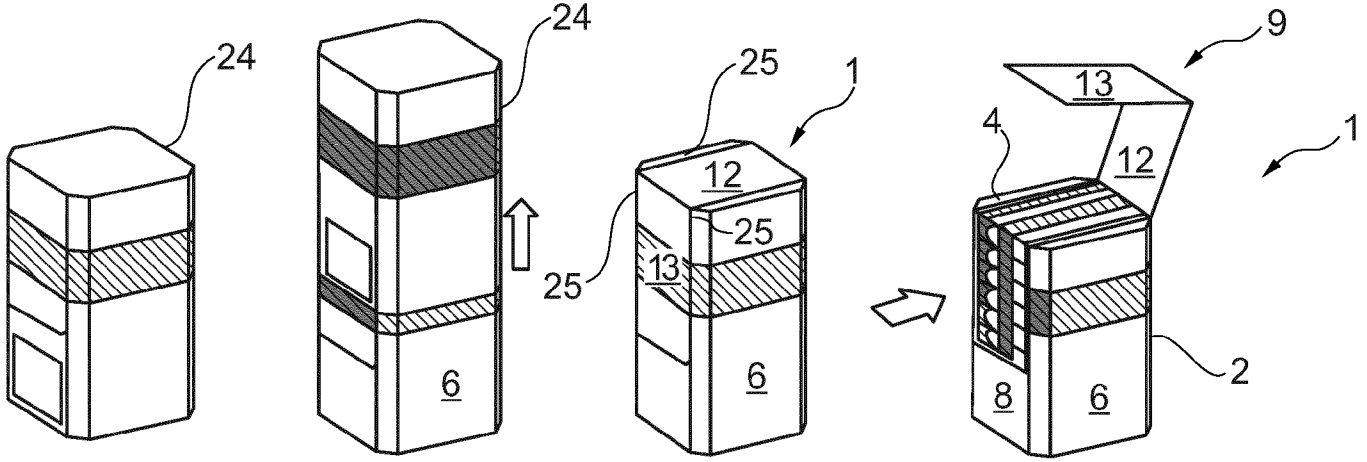
FIG. 8 is a simplified representation of another embodiment of the package.

FIG. 8 is a simplified representation of still another embodiment of the package 1. The package of this embodiment now also comprises an outer package 24. The outer package 24 covers the inner package 1 and must be removed in a first step. The inner package 1 is substantially similar to the previously described embodiments except that substantial parts of the upper wall 4 of the body 2 and the front wall 8 of the body are provided by the walls 12, 13 of the extension flap 9. This means that the extension flap 9 at least partially serves as the top wall 4 and the front wall 8 of the body 2. The walls 12, 13 of the extension flap are coupled to the walls of the body by cutting lines 25 (perforations) except of the first hinge by which the extension flap 9 remains always coupled to the body 2.

Especially, in the embodiments shown in FIGS. 1 to 6 and 8, the extension flap 9 and in particular, the second wall 13 can have a stopping member in order to prevent the body from slipping from the extension flap. The stopping member can be a groove or notch. The stopping member can also be one or more protrusions on the extension flap. The groove, notch, protrusion or protrusion can especially be arranged on the inner side of the second wall 13 of the extension flap 9. The body 2, in particular the lower edge 21 of the body 2 can then rest in the groove or on the protrusion or protrusions.

Figure 9:
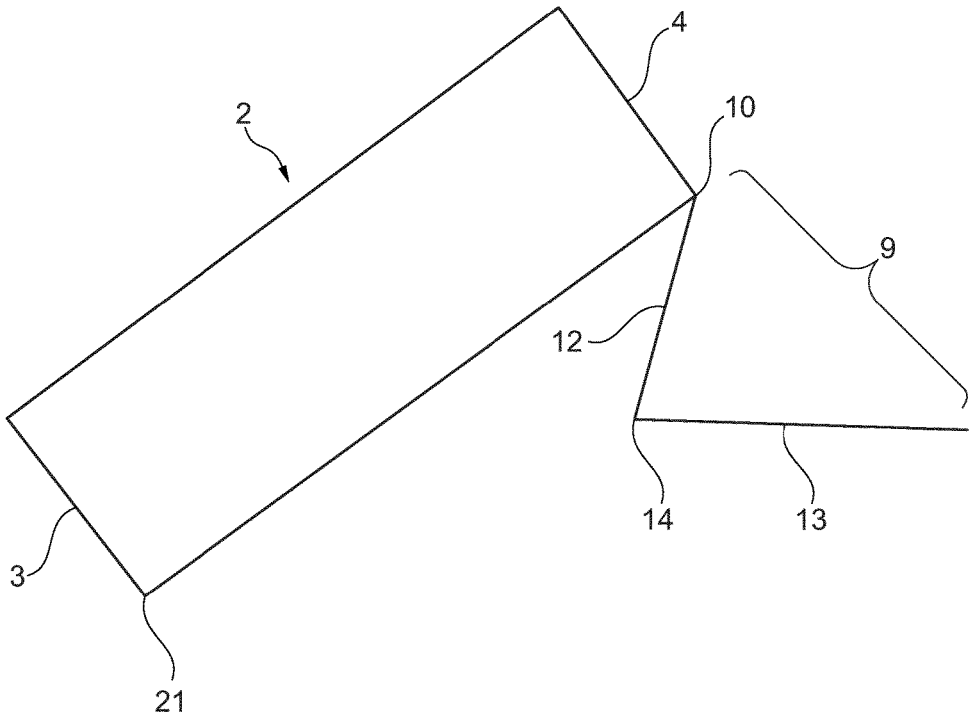
FIG. 9 is a simplified representation of still another embodiment of the package.

FIG. 9 is a simplified representation of still another embodiment of the package 1. In this embodiment, the second wall 13 is actually swiveled in the opposite direction than in the other embodiments. The initial angle between the first wall 12 and the second wall 13 in the first position (closed position) is 90°. This is also the case in the other embodiments. The first wall 12 can be swiveled around the first hinge 10 similar to the other embodiments. The second wall 13 is, however, not swiveled in the same direction about the second hinge 14 as in the other embodiments. If from a side perspective, the first wall 12 is swiveled or rotatable in a clockwise direction, the second wall 13 is rather swiveled or rotatable in a counter-clockwise direction about the second hinge 14. The package stands securely on the extension flap 9. However, the outer edge of the second wall 13 now points away from the rear bottom edge 21 of the bottom wall 3 of the body 2. In this embodiment, the second hinge 14 can preferably have a limitation mechanism for the angle of rotation. This mechanism can be provided by the thickness of walls 12, 13 and/or the configuration of the second hinge 14.

Although the invention has been described hereinabove with reference to specific embodiments, it is not limited to these embodiments and no doubt further alternatives will occur to the skilled person that lie within the scope of the invention as claimed.

The invention claimed is:

1. A package, in particular a package carton for smoking articles and/or tobacco related articles, in particular for packages of smoking and/or tobacco related articles, the package comprising a body having at least a bottom wall, a top wall, a rear wall, a front wall and two side walls, the package further comprising an extension flap coupled to the package and configured to be swiveled around a first hinge between a first position and a second position with respect to the body of the package, the extension flap comprising a first wall and a second wall, wherein there is a groove, protrusion or protrusions formed on an inner side of the second wall of the extension flap, wherein the first hinge has an angle α that is greater than 180° when the extension flap is in the second position, wherein the extension flap is further configured to support the package in the second position of the extension flap such that the body of the package stands securely in an inclined position with respect to a plane on which the package rests, and wherein a lower edge of the body rests in the groove, protrusion or protrusions when the extension flap is in the second position.

2. The package according to claim 1, wherein the extension flap is coupled by the first hinge to an edge of the body of the package.

3. The package according to claim 2, wherein the edge of the body to which the extension flap is coupled is an upper edge of the rear wall of the body such that the first hinge is located between the rear wall and the top wall of the package and the extension flap.

4. The package according to claim 1, wherein the extension flap at least partially encompass the body in the first position.

5. The package according to claim 1, wherein the extension flap is detachably coupled to the body in the first position.

6. The package according to claim 5, wherein the extension flap and the body are coupled by a coupling mechanism.

7. The package according to claim 6, wherein the coupling mechanism is based on magnetism, magnetic ink, Velcro® (a hook-and-loop fastener), YUPOTako® (a film or paper having a microsuction side), buttons, tuck-in flaps, glued, hook-and-loop, push-fit, magnetic and/or a snap-fastener connections or cutting lines (perforations).

8. The package according to claim 1, wherein the first wall and the second wall are coupled by a second hinge.

9. The package according to claim 8, wherein the first wall of the extension flap covers a first side or a first wall of the body and the second wall of the extension flap covers a second side or a second wall of the body.

10. The package according to claim 9, wherein the first side of the body is the top side of the body and/or the second side is the front side of the body.

11. The package according to claim 9, wherein the first wall is the top wall and the second wall is then the front wall of the package, both being covered by the extension flap in the first position.

12. The package according to claim 9, wherein the first wall of the extension flap has at least approximately the size of the top wall of the body and the second wall has at least approximately the size of the front wall of the body.

13. The package according to claim 1, wherein the extension flap at least partially serves as the top wall and/or front wall of the body.

14. The package according to claim 1, wherein the front wall of the body is coupled by a third hinge to one of the side walls of the body for swiveling the front wall about the third hinge in order to open and close the body of the package.

15. The package according to claim 1, wherein the package has a substantially parallelepiped shape and beveled edges.

16. The package according to claim 1, wherein the walls of the body and/or any walls of the extension flap and/or any one of the hinges is configured such that the rotating angle around any one of the hinges is limited.

17. The package according to claim 16, wherein the rotating angle of any of the hinges is greater than 160° and/or wherein at least the second hinge has a rotating angle of less than 180°.

18. The package according to claim 1, further comprising an additional outer package.

19. The package according to claim 1, wherein the extension flap and in particular, the second wall of the extension flap, comprises a stopping member in order to prevent the body from slipping from the extension flap.

20. The package according to claim 1, as far as applicable, wherein the extension flap and in particular, the first wall and/or the second wall comprise a folding line or hinge line for hingedly dividing the first wall and/or second wall into further partial walls.

* * * * *